US005392491A

United States Patent [19]

Hwang et al.

[11] Patent Number: 5,392,491

[45] Date of Patent: Feb. 28, 1995

[54] CLEANER HEAD FOR A VACUUM CLEANER

[75] Inventors: Cheol Hwang; Hyo Y. Jeoung, both of Changwon-si, Rep. of Korea

[73] Assignee: Gold Star Co., Ltd., Seoul, Rep. of Korea

[21] Appl. No.: 967,744

[22] Filed: Oct. 28, 1992

[30] Foreign Application Priority Data

Nov. 1, 1991 [KR] Rep. of Korea ..... 18560/1991

[51] Int. Cl.[6] ..... A47L 9/06

[52] U.S. Cl. ..... 15/322; 15/373; 15/367; 15/393

[58] Field of Search ..... 15/321, 322, 367, 393, 15/373, 400, 147.1, 147.2, 148, 149, 150, 151, 152, 153, 154

[56] References Cited

U.S. PATENT DOCUMENTS

| | | | |
|---|---|---|---|
| 2,769,995 | 11/1956 | Klein | 15/153 |
| 3,599,272 | 8/1971 | Merrick | 15/321 |
| 3,821,831 | 7/1974 | Grover | 15/373 |
| 3,992,747 | 11/1976 | Hufton | 15/322 |
| 4,266,317 | 5/1981 | Duda | 15/321 |
| 4,638,526 | 1/1987 | Murata et al. | 15/367 |
| 4,777,696 | 10/1988 | Hawley et al. | 15/373 |
| 4,833,752 | 5/1989 | Merrick | 15/322 |
| 5,001,806 | 3/1991 | Gurstein | 15/322 |

FOREIGN PATENT DOCUMENTS

| | | | |
|---|---|---|---|
| 3017485 | 11/1981 | Germany | 15/322 |

*Primary Examiner*—David A. Scherbel
*Assistant Examiner*—Reginald L. Alexander
*Attorney, Agent, or Firm*—John P. White

[57] ABSTRACT

There is disclosed a cleaner head having a detachable mop, which can perform simuiltaneously both of dust sucking and floor mopping functions, thereby resulting in enhanced efficiency of cleaning and shortening of cleaning hours. The cleaner head according to the present invention comprises a lower cover moved closely to form a head body; a plurality of rollers mounted on the bottom of the lower cover to permit the head body to be moved freely in any direction; mop holding means for detachably holding the mop behind a dust sucking area; and locking means for locking the mop holding means.

8 Claims, 6 Drawing Sheets

CLEANER HEAD FOR A VACUUM CLEANER

BACKGROUND OF THE INVENTION

1. Field of the Invention

This invention relates to a cleaner head for a vacuum cleaner, and more particularly a cleaner head provided with a detachable mop so that during cleaning operation, dust sucking and floor mopping functions can be performed simultaneously.

2. Description of the Prior Art

Generally, a vacuum cleaner is an apparatus which takes up dust, dirt, etc. on a floor by suction and which comprises a main body and a head connected to the body by a suction tube.

A conventional cleaner head is of the type shown in FIG. 1 of the accompanying drawings, which comprises a head body consisting of an upper cover 31 and a lower cover 32 coupled to the upper cover and moved closely to a surface to be cleaned. The head body is connected to the cleaner body (not shown) by the suction tube 33 which is engaged with the rear connection portions of the upper and lower covers. the lower cover 32 is formed with an air flow path 34 serving as a dust sucking path, and a central suction opening 35.

With this construction, when the cleaner is actuated, suction force is induced by back pressure which is produced by a motor fan disposed in the cleaner body, and dust, dirt, etc. on the floor are sucked and collected in the cleaner body together with air through the air flow path 34 and the central suction opening 35 by the suction force.

This prior art cleaner however has a drawback in that since the cleaner serves only to suck and collect dust, dirt, etc. lain on the floor and soil, dirt, etc. stuck on the floor must be cleaned with soap or a detergent by hand or by using a hand brush, a wet broom or the like, more thorough cleaning cannot be achieved with use of only the cleaner and additionally requires separate cleaning work so that the cleaning process becomes tedious and time-consuming.

SUMMARY OF THE INVENTION

In view of the aforesaid problem of the prior art, it is an object of the present invention to provide a cleaner head for a vacuum cleaner, which can perform simultaneously two functions of sucking dust, dirt, etc. lain on a floor and wiping out soil, dirt, etc. stuck on the floor.

To achieve the above object, there is provided according to one form of the present invention a cleaner head connected to a cleaner body by a suction tube and permitting cleaning of a floor by a mop, the head comprising a lower cover moved closely to the floor to be cleaned; an upper cover coupled to the lower cover to form a head body; a plurality rollers mounted on the bottom of the lower cover to permit the head body to be moved freely in any direction; mop holding means for detachably holding the mop behind a dust sucking area; and locking means for locking the mop holding means.

DESCRIPTION OF THE PREFERRED EMBODIMENT

The invention will now be described in detail, by way of example, with reference to FIGS. 2 to 6 of accompanying drawings.

Figure 1:
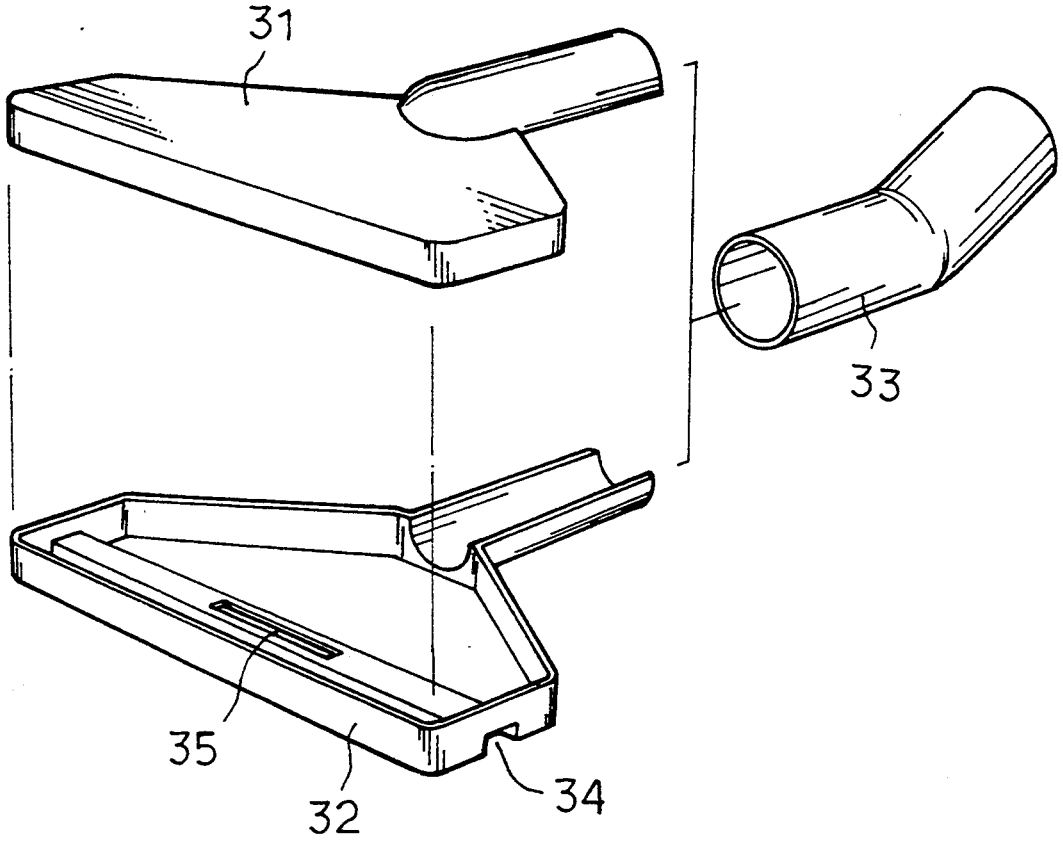
FIG. 1 PRIOR ART
FIG. 1 is a perspective view of a cleaner head according to the prior art.
Figure 2:
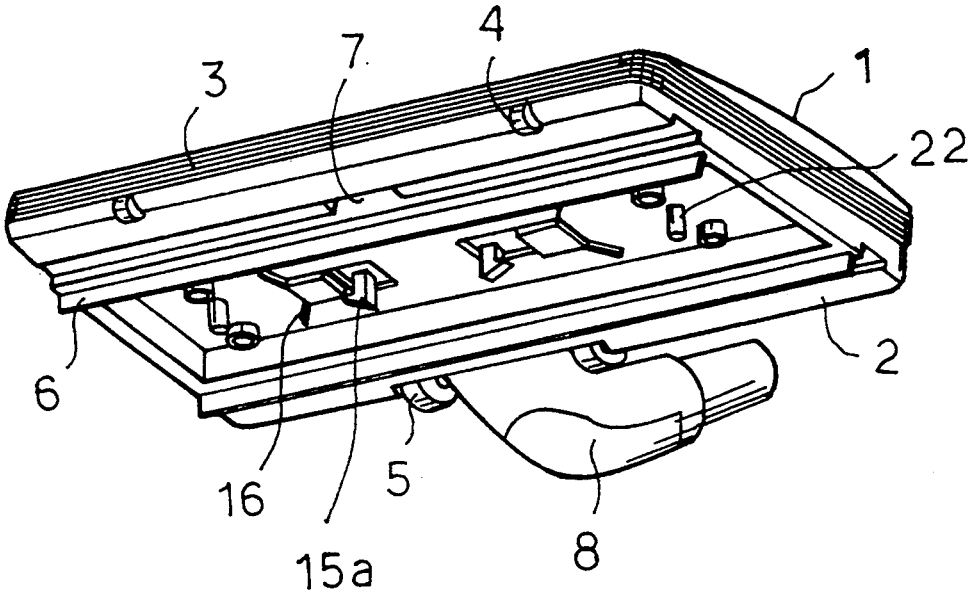
FIG. 2 is a bottom perspective view of a cleaner head according to the present invention.

Referring to FIG. 2 which shows a bottom perspective view of a cleaner head according to the present invention, the cleaner head comprises an upper cover 1; a lower cover 2 coupled to the upper cover to form a head and moved closely to a surface to be cleaned; a buffer 3 attached to the outer periphery of the engaged portion between the upper and lower covers to protect the covers from an external shock; rollers 4 and casters 5 mounted on the bottom of the lower cover 2 to permit the head to be moved freely in any direction; a wiper 6 disposed at one side of the lower cover to sweep up dust or dirt; a suction opening 7 serving as a dust sucking path; a suction tube 8 for connecting the head body to a cleaner body to suck the dust; mop holding means mounted in the head body to detachably hold a mop behind the dust sucking area; and locking means for locking the mop holding means.

Figure 3:
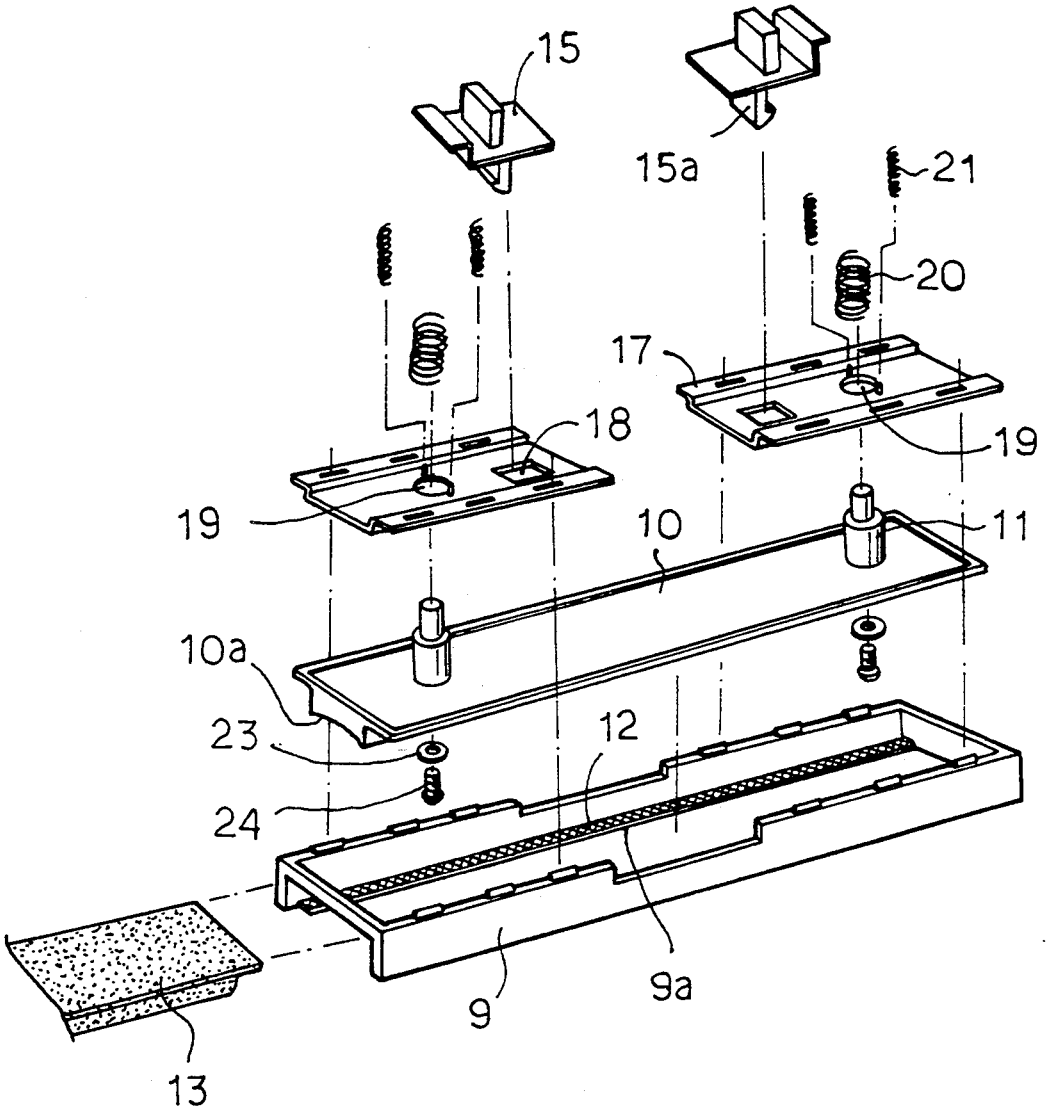
FIG. 3 is an exploded perspective view of mop holding means and locking means of the cleaner head of the present invention.

As shown in FIG. 3, the mop holding means comprises a mop holder 9 and a suppressing plate 10 disposed in the mop holder. The mop holder 9 is of a hexahedral shape having an open top and has step portions 9*a* provided at the opposite sides of its bottom surface, and the suppressing plate 10 is provided with a pair of tubular bosses 11 protruding upwardly from its upper surface and each having a larger diameter portion and a reduced diameter portion. Each step portion 9*a* has plurality of small protrusions 12 formed on its upper surface, and the suppressing plate 10 also has a plurality of small protrusions 10*a* formed on its lower surface. The protrusions 12, 10*a* serve to prevent playing of the mop inserted into the mop holder 9 through one side of the holder and secured between the lower surface of the suppressing plate 10 and the upper surfaces of the step portions 9*a* by pressure applied to the suppressing plate.

Figure 4:
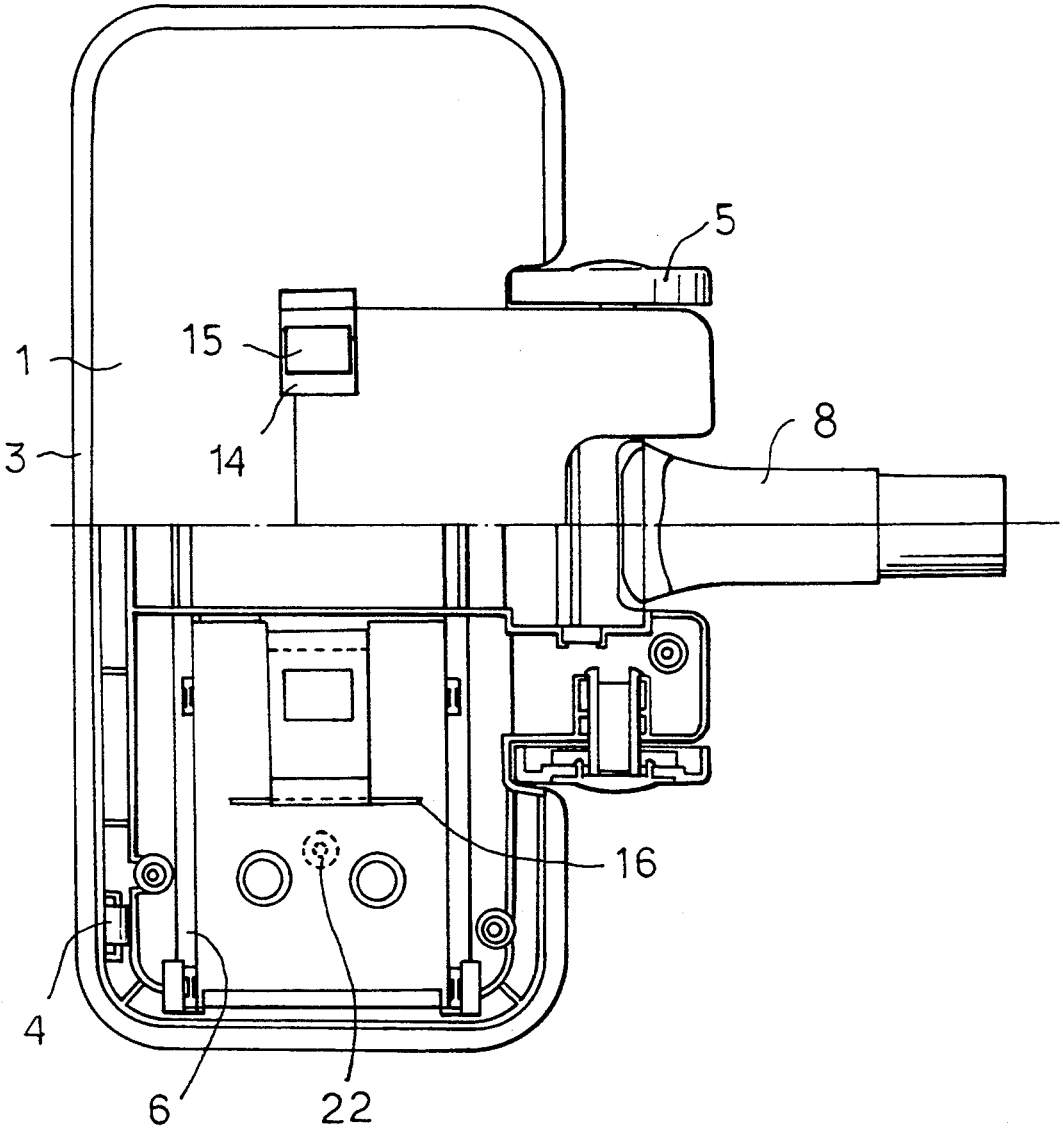
FIG. 4 is a plan view, in partial section, of the cleaner head of the present invention.

As shown in FIGS. 3 and 4, the locking means comprises a pair of knobs 15 movably disposed one in each of openings 14 formed in the upper cover 1; plate springs 16 for normally maintaining the knobs in given positions; holder covers 17 secured to the top of the mop holder 9; and a number of coil springs 20, 21. The plate springs for maintaining the knobs in given positions may be replaced with coil springs.

Each knob 15 has a hook 15*a* integrally formed on its lower surface, and each holder cover 17 is formed with a rectangular hole 18 through which the hook 15*a* extends downwardly, and a circular hole 19 through which the boss 11 of the suppressing plate extends upwardly.

The plate springs 16 are disposed at one side of each knob 15 to apply resilient restoring force to the knob moved leftward or rightward, thereby returning it to its original position. The coil springs 20 are disposed about the bosses 11 between the lower surface of the upper cover 1 and the upper surface of the suppressing plate 10 of the mop holding means to apply pressure to the suppressing plate, and the coil springs 21 are disposed between the lower surface of the upper cover 1 and the upper surface of each holder cover 17 to apply pressure to the mop holding means through the holder cover.

Each of the bosses 11 formed on the suppressing plate 10 is engaged with each of guide bosses 22 integrally formed on the lower surface of upper cover 1, and then a screw 24 is fastened to the free end of the inserted guide boss 22 with a washer 23 intervened between them, whereby the suppressing plate can be moved up and down in the range approximately equivalent to the length of the larger diameter portion of the boss. That is, the mop holding means is movable within the head body a given distance without being completely separated from the body by engagement of the washer 23 secured to the free end of each guide boss 22 with the reduced diameter portion of each boss 11 of the suppressing plate 10.

Polyvinyl alcohol sponge having good water absorptivity may be preferably used as the mop to be inserted into the mop holding means because the sponge provides increased efficiency of cleaning.

The cleaner head thus constructed can perform simultaneously the dust sucking and floor mopping functions in the state in which the mop chosen depending upon the object to be cleaned is mounted thereto, and can be used for only the dust sucking function, as in the conventional vacuum cleaner, when the mop is removed.

Use of the cleaner head according to the present invention will now be explained with reference to FIGS. 5*a* and 5*b*.

Figure 5A:
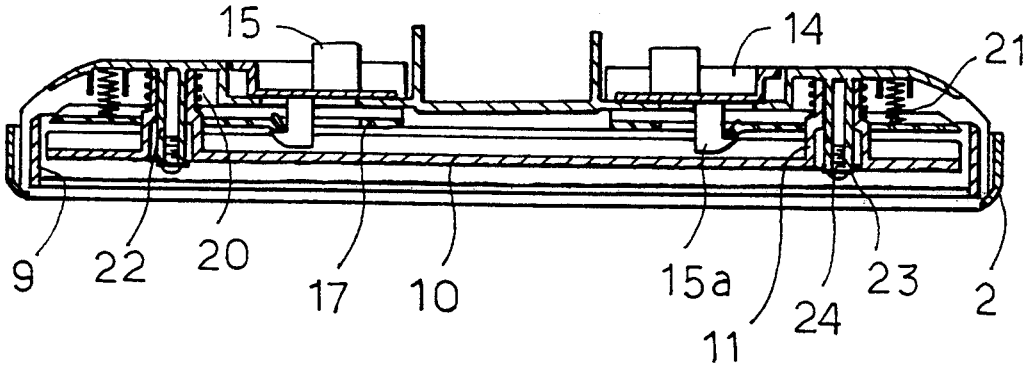
FIG. 5*a* is a cross-sectional view showing the state in which a mop has not been mounted to the mop holding means.
Figure 5B:
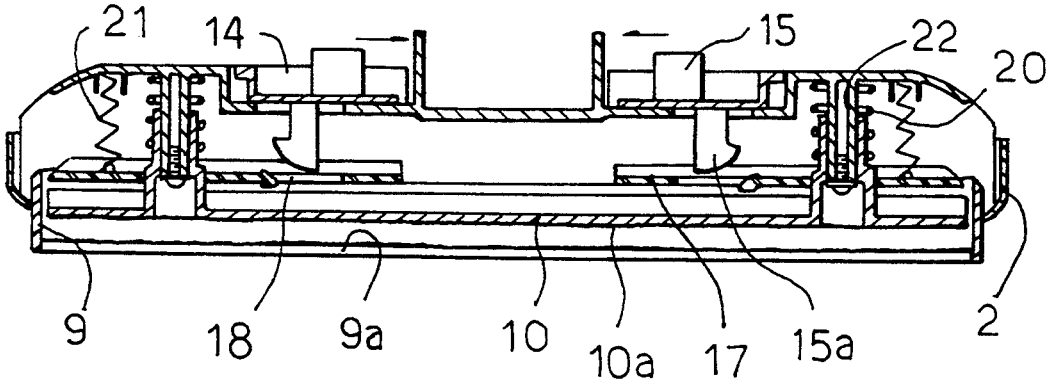
FIG. 5*b* is a cross-sectional view showing the state in which the mop holding means has been protruded below a lower cover to permit the mop to be mounted thereto.

FIG. 5*a* is a cross-sectional view showing the state in which the mop 13 has not been mounted to the mop holding means, and FIG. 5*b* is a cross-sectional view showing the state in which the mop holding means has been protruded below the lower cover to permit the mop to be mounted thereto.

When the cleaner is used without having the mop mounted to the cleaner head, as shown in FIG. 5*a*, the cleaner head is in the state in which the hooks 15*a* integral with the knobs 15 are engaged with the hook receiving holes 18 formed in the holder covers 17 and the coil springs 20, 21 are compressed. In this condition, when the cleaner head is connected to the cleaner body by the suction tube, and the cleaning work is carried out, dust on the floor is swept up by the wiper 6 and sucked into the cleaner body through the suction opening 7 of the lower cover 2 and the suction tube 8, whereby the cleaner performs the cleaning operation, as in the prior art cleaner without having a mopping function.

Then, when the user wishes to use the cleaner with the mop mounted to the cleaner head, the knobs 15 are manually pushed toward each other, i.e. toward the center of the head body, so that the mop holder 9 is protruded below the lower cover 2, as shown in FIG. 5*b*. Then, the mop is mounted to the protruded mop holder.

More specifically, when the knobs 15 are pushed toward each other against the bias of the plate springs 16, as shown in FIG. 5*b*, the hooks 15*a* of the knobs are disengaged from the hook receiving holes 18 of the holder covers 17, and at the same time the mop holder 9 descends below the lower cover 2 by the force of the springs 21 disposed between the upper cover 1 and the holder covers 17. In this state, the mop 13 (see FIG. 3) is inserted into the space between the step portions 9*a* of the mop holder and the suppressing plate 10. Then, when the mop holder 9 with the mop mounted thereto is pressed toward the upper cover, the hooks 15*a* of the knobs 15 are again engaged with the hook receiving holes 18 of the holder covers 17 and the mop is secured tightly without playing by the suppressing force of the springs 20 applied to the suppressing plate 10.

Figure 6:
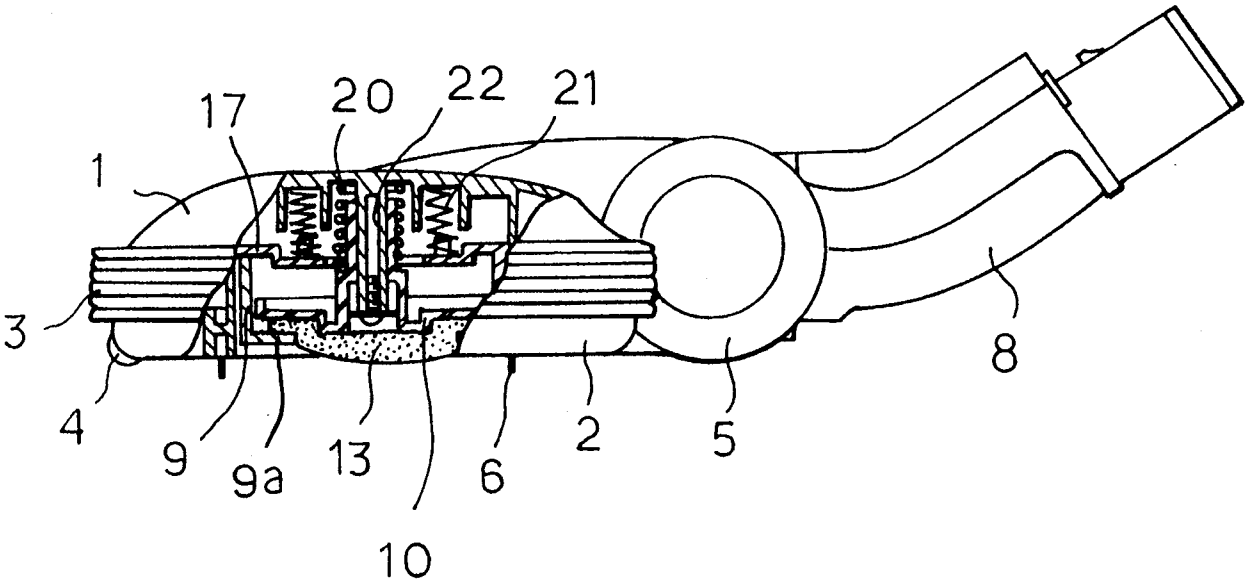
FIG. 6 is a side elevational, partly sectional view of the cleaner head with the mop attached thereto.

The cleaner head with the mop 13 attached to the mop holder 9 is shown in partial section in FIG. 6. In this condition, when the cleaner head is connected to the cleaner body by the suction tube, and then cleaning work is carried out, dust on the floor is swept up by the wiper 6 and sucked into the cleaner body through the suction opening 7 and the suction tube, while the mop 13 cleans the floor, whereby more thorough cleaning can be achieved.

When it is necessary to exchange or wash the used mop, the knobs 15 are pushed toward each other so that the mop holder 9 is protruded below lower cover 2. Then, the mop may be simply separated and taken out from the mop holder.

From the foregoing it will be appreciated that the present invention provides an efficient cleaner head having a detachable mop, which can perform simultaneously the dust sucking and floor mopping functions, thereby resulting in enhanced efficiency of cleaning and shortening of cleaning hours.

While the invention has been shown and described with particular reference to a preferred embodiment thereof, it will be underestood that variations and modifications in form and detail may be made therein without departing deparing from the spirit of the invention as defined in the appended claims.

What is claimed is:

1. A cleaner head for a vacuum cleaner comprising:

an upper cover having at least one guide boss and at least one opening thereon;

a lower cover having a plurality of rollers for permitting the cleaner head to be moved around, said lower cover making up a head body together with said upper cover;

a mop;

mop holding means housed in said head body for holding said mop, said mop holding means being movable in a vertical direction; and locking means for locking said mop holding means inside said head body by preventing said mop holding means from moving in said vertical direction, such that said mop is held by said mop holding means when said locking means is locked and said mop is released by said mop holding means when said locking means is unlocked.

2. A cleaner head for a vacuum cleaner as claimed in claim 1, wherein said mop holding means comprises:

a mop holder for containing said mop, said mop holder having at least one step portion with a rough surface thereon to tightly hold said mop in conjunction with a suppressing plate;

said suppressing plate having at least one boss, said boss having a first portion of a first diameter into which said guide boss is inserted and a second portion of a second diameter wider than said first diameter; and a bolt means having a washer, said bolt means attached to said guide boss, from inside said boss such that said mop holding means descends to where said washer intervenes with said first portion of said boss when said locking means is unlocked.

3. A cleaner head for a vacuum cleaner as claimed in claim 1, wherein said locking means comprises:

at least one knob integrally formed with a hook, said knob being movable within said opening on said upper cover, to release said mop holding means;

a holder cover attached to said mop holding means having at least one hook opening for receiving said hook and at least one boss opening for receiving at least one boss attached to said mop holding means; and a plurality of springs for moving said mop holding means and for providing a suppressing force to a suppressing plate in said head body.

4. A cleaner head for a vacuum cleaner as claimed in claim 1, wherein said cleaner head further comprises;

a suction opening connected to the vacuum cleaner for sucking dust and said suction opening is positioned relative to said mop such that said mop cleans a floor after dust is sucked.

5. A cleaner head for a vacuum cleaner as claimed in claim 3, further comprising knob spring means for providing returning force to said at least one knob after said knob is moved to release said mop holding means.

6. A cleaner head for a vacuum cleaner as claimed in claim 1, wherein said mop comprises a polyvinyl alcohol sponge.

7. A cleaner head for a vacuum cleaner comprising:

mopping means for mopping a floor;

a head member for containing said mopping means, said head member having a plurality of rollers for permitting the head to be moved around, holding means vertically moveable inside said head member for detachably holding said mopping means and locking means for locking said holding means inside said head member and for unlocking said holding means when said mopping means is to be attached to or detached from said holding means, such that said mopping means is held by said holding means when said locking means is locked and said mopping means is released by said holding means when said locking means is unlocked; and connection means for connecting said head member to the vacuum cleaner.

8. A cleaner head for a vacuum cleaner as claimed in claim 7, wherein said cleaner head further comprises:

a suction opening connected to said connecting means for sucking dust and said suction opening is positioned relative to said mopping means such that said mopping means mops a floor after dust is sucked.

* * * * *